United States Patent [19]

Garvin

[11] 4,344,342

[45] Aug. 17, 1982

[54] METHOD FOR THE MANUFACTURE OF WASHERS AND THE LIKE

[75] Inventor: George R. Garvin, River Forest, Ill.

[73] Assignee: Sam Garvin & Company, Chicago, Ill.

[21] Appl. No.: 181,710

[22] Filed: Aug. 27, 1980

[51] Int. Cl.[3] ..... B21D 28/00; B21D 53/00

[52] U.S. Cl. ..... 83/45; 10/86 B; 83/49; 83/52; 83/255; 83/405; 83/406; 83/917

[58] Field of Search ..... 10/72 R, 85, 86 B; 83/49, 255, 405, 406, 683, 682, 681, 917, 52, 42, 43, 45

[56] References Cited

U.S. PATENT DOCUMENTS

| | | | |
|---|---|---|---|
| 834,372 | 10/1906 | Dunham | 83/917 X |
| 1,879,555 | 9/1932 | Simmons | 10/86 B |
| 2,052,063 | 8/1936 | Wenn | 10/72 |
| 3,202,033 | 8/1965 | Weidner | 85/1 |
| 3,362,449 | 1/1968 | Barwick et al. | 151/37 |
| 3,654,830 | 4/1972 | Werner | 83/255 X |
| 3,748,674 | 7/1973 | Powell et al. | 10/72 R |
| 4,114,218 | 9/1978 | Pendell | 10/86 B |

FOREIGN PATENT DOCUMENTS

| | | | |
|---|---|---|---|
| 261657 | 11/1926 | United Kingdom | 83/72 |

*Primary Examiner*—James M. Meister

*Attorney, Agent, or Firm*—Fitch, Even, Tabin, Flannery & Welsh

[57] ABSTRACT

A method of producing washers and the like from a strip of sheet material having at least one straight edge, in which scrap generation is minimized.

7 Claims, 2 Drawing Figures

METHOD FOR THE MANUFACTURE OF WASHERS AND THE LIKE

This invention relates to a method of production of washers and the like from a strip of sheet material.

Washers and the like have traditionally been manufactured by die cutting an array of round shapes from a presized strip of sheet material using a two station progressive blanking die. The sheet material is usually available in the form of a long strip. If the sheet material has enough elasticity the strip may be coiled to facilitate handling. The strip is advanced a discrete interval of length into the first station of the open die. As the die is closed the center hole or inside diameter of the washer is punched. The die is then opened and the strip is again advanced into the die so that the centerhole is now positioned in the second station. As the die is closed, a second punch "blanks" the outside diameter of the washer around the centerhole and the finished part is severed from the strip of sheet material.

When stamping an array of such washers it is not practical to arrange the pieces such that their edges lie tangent to one another or to the edges of the sheet material. This is due to the limitations of dimensional tolerance inherent to a blanking operation coupled with the geometry of the pieces. Thus, a web of unused material is formed that results in the generation of substantial amounts of scrap.

Such scrap may, of course, be reclaimed but if the sheet material initially includes a corrosion resistant coating, reclamation is more costly. While uncoated scrap may be reclaimed as is, coated and plated scrap must first be stripped. This additional expense can easily render reworking of such scrap economically unfeasible.

It is therefore the principal object of this invention to provide a method of producing washers and the like from a strip of sheet material having at least one straight edge, that minimizes the amount of scrap generated from such production.

The accomplishment of this and other objects of the invention will become apparent from the following description and its accompanying drawings in which.

In accordance with a preferred embodiment of this invention, washers and the like, having an octagonal perimeter, are die cut from a continuous strip of sheet material.

Figure 1:
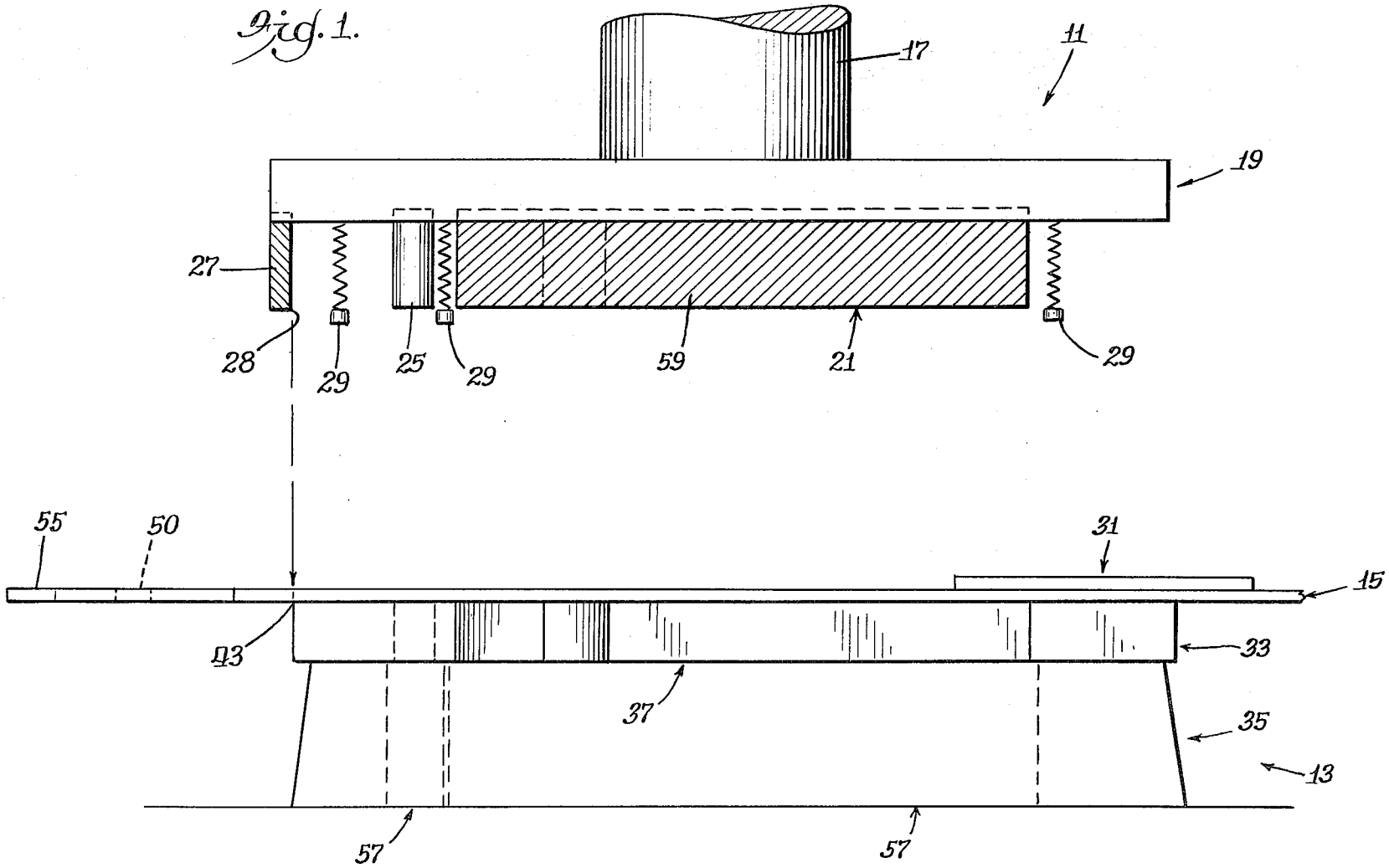
FIG. 1 is a front view of a strip of sheet material in an open four station progressive blanking die showing the movable punch section and the stationary die section.

The four station progressive blanking die as viewed in FIG. 1 comprises: a movable punch section 11; a stationary die section 13; working stock in the form of a continuous strip of sheet material with one straight edge 15; and a means (not shown) for advancing the sheet material into the die in discrete intervals of length.

Figure 2:
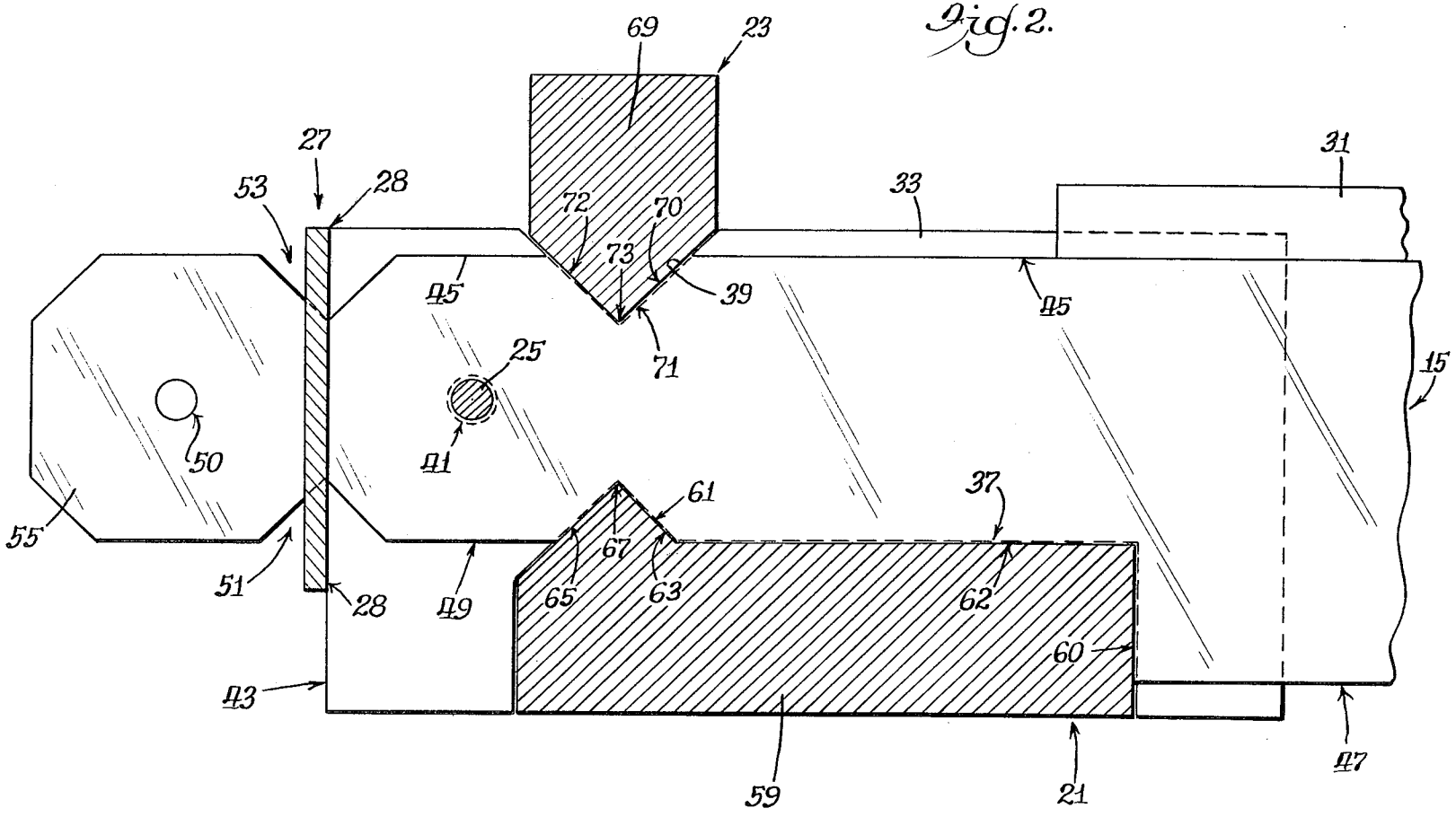
FIG. 2 is a top view of FIG. 1 showing a cross section of the die cutting punches, the die block, guide bar and a finished washer. For purposes of clarity the punch mount, ram, strippers and bolster have not been included.

As shown in FIG. 2, the working stock; in the form of a continuous strip of sheet material 15, has: a straight edge 45; an incoming free edge 47; a trimmed edge 49; a center hole 50; and a pair of V notches indicated by reference numerals 51 and 53. A finished washer 55 is produced when the strip of sheet material has been severed along a line joining the vertices of notches 51 and 53. The thickness of the sheet material determines the thickness of the finished washer.

The movable punch section 11 (FIG. 1) includes a ram 17; a punch mount 19; a notching and trimming punch 21; a notching punch 23 (shown only in FIG. 2); a centerhole punch 25; a cutoff punch 27; and a plurality of strippers 29.

The ram 17 provides downward force in the direction of its axis through means such as a mechanical or hydraulic press. The punch mount 19 is securely attached to the ram and distributes this load over the four punches 21, 23, 25 and 27. All four punches are anchored to the punch mount. The mount and punches may be manufactured as a single unit or independently. If quick replacement is desired punches can be fastened to the mount by means such as bolts. Recessed cavities in the mount may be used to aid proper punch positioning.

Referring now to FIG. 2, the cross section of the notching and trimming punch 21 is generally that of a rectangle 59 with a depending triangular member 61. The cross sectional shape is uniform over most of the punch's height as are all punches described herein. The rectangular portion of this punch provides two orthogonal cutting edges 60 and 62 for trimming and sizing the sheet. The depending triangular cutting member has two orthogonal cutting edges 63 and 65. The lines defined by the projection of edges 63 and 65 on the plane of the sheet material 15 and the line defined by the trimmed edge of the sheet 49 form a right isosceles triangle with the right angle vertex 67 opposite the trimmed edge.

The cross section of the notching punch 23 shows a rectangular mount 69 with a depending triangular cutting member 71. Like that of the notching and trimming punch, this triangular cutting member has two orthogonal cutting edges indicated by reference numerals 70 and 72. The lines defined by the projection of these edges on the plane of the sheet material 15 and the line defined by the straight edge 45 of the sheet form a right isosceles triangle with the right angle vertex 73 opposite the straight edge. The perpendicular distance from the straight edge of the sheet to the right angle vertex 73 is substantially the same as the perpendicular distance from the trimmed edge of the sheet 49 to the right angle vertex 67 described in conjunction with the notching and trimming punch 21.

The notching and trimming punch 21 is oriented in the die so that the line defined by the projection of cutting edge 62 on the plane of the sheet 15 is parallel to the straight edge of the sheet 45. The notching punch 23 is aligned so that its right angle vertex 73 and the right angle vertex 67 of punch 21 lie along a line perpendicular to the straight edge sheet 45.

The center hole punch, whose circular cross section is indicated by reference numeral 25 in FIG. 2 is longitudinally positioned midway between the cutting edge 28 of the cutoff punch 27 and the line joining right angle vertices 67 and 73 of punches 21 and 23. It is transversely located midway between the straight 45 and trimmed 49 edges of the sheet. The positioning and shape of this punch can be altered to accommodate the needs of the product produced. If, for example, an electrical junction box cover is to be produced by this method, off-center and non-circular locating and fastening holes may be required. The punch's shape and positioning can then be adjusted accordingly.

The cutoff punch 27 severs the finished part 55 from the main body of the sheet. The projection of its cutting edge 28 on the plane of the sheet 15 forms a line perpendicular to the straight edge of the sheet 45. It is aligned so that the line of severence passes through the vertices of the V notches 51 and 53 that have been stamped in the straight 45 and trimmed 49 edges of the sheet.

Referring to FIG. 1, the stationary die section generally indicated by reference numeral 13 comprises: a guide bar 31; a die block 33; and a bolster 35.

The general shape of the die block 33 is best shown in FIG. 2. Its overall shape is that of a rectangular plate into which three die cavities have been cut, indicated by reference numerals 37, 39 and 41. These cavities correspond in shape and location to punches 21, 23 and 25 respectively. The location of punch 27 corresponds to the outside cutting edge 43 of the die block 33. The dimensions of the die cavities are slightly larger than the cross sections of their corresponding punches. Slight clearance is also provided between punch 27 and the outside cutting edge 43 of the die block 33. This allows the punches to travel freely through the die cavities on the downward stroke of the movable punch section 11. The amount of clearance provided will vary with the thickness and type of sheet material used as working stock. The clearance must be great enough to provide free punch travel but small enough to effectively shear the material. When die cutting mild steel clearance is typically in the range of 5–8% of thickness.

The sheet material 15 rests directly on the die block 33 (FIG. 1). As shown in FIG. 2 its transverse position in the die is maintained by butting the straight edge of the sheet 45 directly against the rectangular guide bar 31. The position of the guide bar is fixed throughout the die cutting operation.

As the punch section of the die 11 is moved downward (FIG. 1) the punches eventually contact the sheet material. Downward movment of the sheet and die block is resisted by the bolster 35. As the load provided by the ram 17 becomes great enough, the punches continue their movement through the die cavities, shearing away sections of sheet material. The location and shape of these sections correspond to the positioning and cross sectional shapes of the punches, as viewed in FIG. 2. The scrap material sections, thus sheared away, are disposed of through a plurality of channels 57 cut in the bolster 35.

Once the scrap material has been sheared from the sheet, the punch section is raised so the die is again in the open position. As the punches are pulled out through the die cavities, frictional forces cause the remaining sheet material to stick to the punches. For this reason spring loaded devices or even blocks of firm foam rubber called strippers 29, FIG. 1, are used to apply hold-down pressure to the sheet material. The strippers extend below the punches so that hold-down pressure is not released until the punches have cleared the sheet material. The number and location of these strippers will vary with the physical properties of the sheet material and the dimensions of the parts produced.

To reduce the amount of force required by the arm 17 to shear the sheet material, the punch face may be made at an angle so that the cutting action is progressive. This distributes the shearing action over a greater length of the punch stroke and can materially reduce the load required.

The cutting die used for this method of manufacturing octagonal washers and the like is described as a four station progressive blanking die. The name derives from the four sequential operations performed on the sheet material as it passes through the die. The operations are termed trimming, notching, punching and shearing.

The strip of sheet material 15 is advanced into the open die a discrete interval of length in a direction from right to left as viewed in FIGS. 1 and 2. The length of such interval is determined by the dimensions of the desired part. After each such advancement, the sheet material comes to rest. The die is then closed, and after shearing away the scrap material sections, reopened. This advancement and punch cycle is repeated until the desired number of parts have been manufactured. While all punches operate simultaneously, only one operation is performed on any given segment of the sheet with each stroke of the punch section 11.

The first operation performed on the incoming sheet material 15 is that of trimming by the rectangular portion 59 of the notching and trimming punch 21 (FIG. 2). It is not necessary that the free edge of the sheet 47 be a straight edge as punch 21 causes a new trimmed edge 49 to be produced. This trimmed edge is parallel to the straight edge 45 of the sheet and its distance from that straight edge is determined by the desired width of the final product.

As the advancement and punch cycle is repeated, the trimmed sheet segment moves to the second station where a pair of V notches, 51 and 53, is cut in the straight 45 and trimmed 49 edges of the sheet by the depending triangular members 61 and 71 of punches 21 and 23, respectively. The vertex of each notch is a 90° angle. The notches are positioned such that the vertices of each pair of notches lie along a line perpendicular to the trimmed 49 and straight 45 edges of the sheet. The legs of all such notches are of equal length.

After notching, the sheet is again advanced so the third operation, punching, can be performed on the notched and trimmed segment. As the punch cycle is repeated, a centerhole 50, is introduced by the centerhole punch 25.

Finally, the sheet is again advanced and the trimmed, notched and punched segment is then ready for the fourth operation, shearing, by the cutoff punch 27. As the punch cycle is repeated, the cutoff punch severs the finished part 55 from the main body of the remaining sheet material. The line of severance is perpendicular to the straight 45 and trimmed 49 edges of the sheet and passes through the vertices of opposing V notches 51 and 53. This renders a finished part 55 in the general shape of an octagon.

As the sheet advancements and the punch cycles are repeated the strip of sheet material is consumed. Its entire length is trimmed to a desired width, and given parallel edges with a plurality of pairs of opposing V notches in those edges. The pairs of notches are evenly spaced by the length of the interval of advancement over the entire length of the strip as are the center holes. The strip of sheet material is severed in segments along straight lines passing through the vertices of each pair of opposing V notches by the cutoff shear, thereby producing the finished washers.

From the foregoing it should be appreciated that a novel method of producing washers and the like has been described. By producing these pieces in a one dimensional array along a strip of sheet material and changing their geometry from circular to octagonal, it is possible to substantially reduce the amount of sheet material consumed per piece produced. In this process each piece generated shares two of its edges with adjacent pieces. This eliminates the scrap webbing that is produced when conventional round pieces are stamped. The scrap savings from this method become particularly important when products are die cut from material having a corrosion resistant coating and scrap reclamation is prohibitively expensive.

It should be understood although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

What is claimed is:

1. A method for the manufacture of washers and the like from a strip of sheet material having one straight edge, said method comprising:

positioning said straight edge along a guide means;

notching said sheet by die cutting a pair of opposing V notches through the thickness of said sheet material in such a manner that the legs of one such V notch extend from its vertex to one edge of said sheet material and the legs of the other V notch extend from its vertex to the opposite edge of said sheet material;

simultaneously with said notching step, trimming said sheet material to a predetermined width;

said trimming being carried out by die cutting material from the edge opposite said straight edge to produce a sheet of desired width having parallel edges;

advancing said sheet material in a direction parallel to said straight edge, and shearing said sheet material at a line joining the vertices of each pair of V notches.

2. A method in accordance with claim 1 wherein said pairs of V notches are made in such a manner that the legs of each said V notch are equal in length and intersect the edges of said sheet to form pairs of isosceles triangles.

3. A method in accordance with claim 1 wherein the depth of each of said V notches as measured from the notch vertex to the edge of said sheet in which said notch is formed, along a line perpendicular to said edge, is less than one-half the width of said sheet.

4. A method in accordance with claim 1 wherein the vertices of each said pair of V notches so formed lie opposite one another along a line perpendicular to said straight edge.

5. A method in accordance with claim 1 further comprising the step of cutting fastener holes in said sheet material.

6. A method in accordance with claim 5 further comprising cutting said fastener holes simultaneously with the steps of notching and trimming.

7. A method in accordance with claim 1 wherein said sheet is advanced a distance equal to the trimmed, predetermined width of said sheet.

* * * * *